US011834780B2

(12) United States Patent
Guo et al.

(10) Patent No.: US 11,834,780 B2
(45) Date of Patent: Dec. 5, 2023

(54) PROCESS FOR FORMING SYNTHETIC LEATHER

(71) Applicants: Dow Global Technologies LLC, Midland, MI (US); Rohm and Haas Company, Collegeville, PA (US)

(72) Inventors: Yunlong Guo, Shanghai (CN); Yi Zhang, Shanghai (IN); Zhaohui Qu, Shanghai (CN); Xiangyang Tai, Shanghai (CN)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 385 days.

(21) Appl. No.: 17/267,930

(22) PCT Filed: Aug. 21, 2018

(86) PCT No.: PCT/CN2018/101464

§ 371 (c)(1),
(2) Date: Feb. 11, 2021

(87) PCT Pub. No.: WO2020/037487

PCT Pub. Date: Feb. 27, 2020

(65) Prior Publication Data

US 2021/0180246 A1 Jun. 17, 2021

(51) Int. Cl.
*D06M 15/05* (2006.01)
*D06N 3/14* (2006.01)

(52) U.S. Cl.
CPC ..... *D06N 3/14* (2013.01); *D06M 15/05* (2013.01)

(58) Field of Classification Search
CPC ..... D06M 15/05; D06N 3/14; D06N 3/0086; D06N 3/02
See application file for complete search history.

(56) References Cited

U.S. PATENT DOCUMENTS 3,294,724 A 12/1966 Axelrood
3,410,817 A 11/1968 McClellan, Jr. et al.
3,412,054 A 11/1968 Milligan et al.
5,518,764 A 5/1996 Traubel et al.
(Continued)

FOREIGN PATENT DOCUMENTS

CN 105155311 A * 12/2015
JP 2003321648 A * 11/2003
(Continued)

OTHER PUBLICATIONS

K. Michael Liu et al., Journal of Chromatography A, 1104 (2006) 145-153.
Machine translation of RU2023098C1.

*Primary Examiner* — Cachet I Proctor
(74) *Attorney, Agent, or Firm* — Boyle Fredrickson, S.C.

(57) ABSTRACT

Provided are a process, the process includes (i) first, contacting a textile with an aqueous solution containing a cationic hydroxyethylcellulose polymer to form a modified textile component; (ii) subsequently, impregnating the modified textile component with an aqueous polyurethane dispersion externally stabilized with an anionic surfactant, the aqueous polyurethane dispersion including a second surfactant; and (iii) precipitating the polyurethane in the modified textile component. Also disclosed are a synthetic leather produced by the process.

10 Claims, 3 Drawing Sheets

(56) References Cited

U.S. PATENT DOCUMENTS

| | | | | |
|---|---|---|---|---|
| 5,539,021 | A | 7/1996 | Pate et al. | |
| 5,688,842 | A | 11/1997 | Pate, III et al. | |
| 5,959,027 | A | 9/1999 | Jakubowski et al. | |
| 6,231,926 | B1 | 5/2001 | Ronzani et al. | |
| 6,315,824 | B1 | 11/2001 | Lauzon | |
| 6,890,602 | B2 | 5/2005 | Romani | |
| 7,306,825 | B2 * | 12/2007 | Mobley | D06N 3/0052 523/335 |
| 8,858,876 | B2 | 10/2014 | Zhang et al. | |
| 9,668,947 | B2 | 6/2017 | Tonani et al. | |
| 9,783,926 | B2 | 10/2017 | Irnich et al. | |
| 10,280,486 | B2 | 5/2019 | Zhang et al. | |
| 10,400,391 | B2 | 9/2019 | Cardinali et al. | |
| 2004/0006857 | A1 | 1/2004 | Romani | |
| 2004/0121113 | A1 * | 6/2004 | Mobley | D06N 3/0052 428/85 |
| 2007/0265183 | A1 * | 11/2007 | Meine | C11D 3/50 512/3 |
| 2009/0263431 | A1 | 10/2009 | Fugmann et al. | |
| 2009/0311929 | A1 | 12/2009 | Schuette | |
| 2012/0213725 | A1 * | 8/2012 | Galleguillos | C08K 5/0008 510/476 |
| 2013/0266624 | A1 | 10/2013 | Tonani et al. | |
| 2013/0288551 | A1 | 10/2013 | Irnich et al. | |
| 2014/0119979 | A1 | 5/2014 | Zhang et al. | |
| 2014/0302734 | A1 * | 10/2014 | Irnich | D06M 15/09 427/331 |
| 2014/0377125 | A1 | 12/2014 | Zhang et al. | |
| 2015/0093565 | A1 * | 4/2015 | Imich | C08G 18/6625 427/350 |
| 2015/0259851 | A1 | 9/2015 | Gu et al. | |
| 2015/0275421 | A1 | 10/2015 | Cardinali et al. | |
| 2015/0284902 | A1 * | 10/2015 | Bhattacharjee | C08G 18/12 428/151 |
| 2015/0299945 | A1 * | 10/2015 | Gu | D06N 3/144 428/319.3 |

FOREIGN PATENT DOCUMENTS

| | | | | |
|---|---|---|---|---|
| JP | 2004182791 | A * | 7/2004 | |
| RU | 2023098 | C1 | 11/1994 | |
| TW | 201414901 | A | 4/2014 | |
| WO | 2005/040488 | A1 | 5/2005 | |
| WO | 2011/137565 | A1 | 11/2011 | |
| WO | WO-2014077403 | A1 * | 5/2014 | C11D 1/835 |
| WO | 2018/037039 | A1 | 3/2018 | |

* cited by examiner

PROCESS FOR FORMING SYNTHETIC LEATHER

BACKGROUND

The present disclosure relates to a process for forming a synthetic leather.

A growing number of applications exist for synthetic leather, including clothing, footwear, bags and luggage, home upholstery, and automobile seats. Synthetic leather can exhibit similar performance and handfeel to natural leather, but synthetic leather provides the added advantages of being animal-friendly and less expensive to produce. Synthetic leather is conventionally produced by impregnating a polyurethane solution containing an organic solvent (e.g., dimethyl formamide (DMF)) into a textile and then adding water to precipitate the polyurethane and form a porous polyurethane matrix. The porous structure gives the synthetic leather the soft handfed that is similar to natural leather. DMF is hazardous to manufacturers, processors, consumers, and the environment.

Attempts have been made to form synthetic leather without organic solvent by utilizing aqueous polyurethane. Known is the foaming (or frothing) of the aqueous polyurethane dispersion, and applying the foamed polyurethane dispersion onto a textile, and then drying the textile. However, the relatively high viscosity required by the aqueous polyurethane dispersion in order to provide stability to the foam bubbles (during application and drying) impedes impregnation of the aqueous polyurethane dispersion into the textile. Broken air bubbles lower the porosity of the resulting polyurethane matrix, which deteriorates the soft handfeel of the resulting synthetic leather.

The art recognizes the need for the production of synthetic leather which avoids the use of organic solvents. The art further recognizes the need for aqueous-based production synthetic leather.

SUMMARY

The present disclosure provides a process. The process includes (i) first, contacting a textile with an aqueous solution containing a cationic hydroxyethylcellulose polymer to form a modified textile component; (ii) subsequently, impregnating the modified textile component with an aqueous polyurethane dispersion externally stabilized with an anionic surfactant, the aqueous polyurethane dispersion including a second surfactant; and (iii) precipitating the polyurethane in the modified textile component.

The present disclosure also provides a synthetic leather formed by the process.

DEFINITIONS

Figure 1:
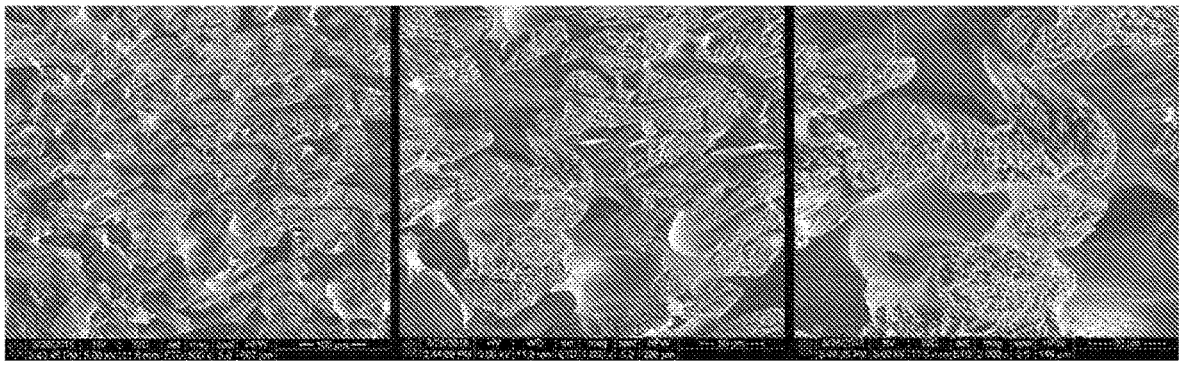
FIG. 1 shows scanning electron microscope (SEM) micrographs of Comparative Sample 1, at 500× magnification (left), 1000× magnification (center), and 2000× magnification (right).

Any reference to the Periodic. Table of Elements is that as published by CRC Press, Inc., 1990-1991. Reference to a group of elements in this table is by the new notation for numbering groups.

For purposes of United States patent practice, the contents of any referenced patent, patent application or publication are incorporated by reference in their entirety (or its equivalent US version is so incorporated by reference) especially with respect to the disclosure of definitions to the extent not inconsistent with any definitions specifically provided in this disclosure) and general knowledge in the art.

The numerical ranges disclosed herein include all values from, and including, the lower and upper value. For ranges containing explicit values (e.g., a range from 1, or 2, or 3 to 5, or 6, or 7), any subrange between any two explicit values is included (e.g., the range 1-7 above includes subranges 1 to 2; 2 to 6; 5 to 7; 3 to 7; 5 to 6; etc.).

Unless stated to the contrary, implicit from the context, or customary in the art, all parts and percents are based on weight and all test methods are current as of the filing date of this disclosure.

The term "alkyl" refers to an organic radical derived from an aliphatic hydrocarbon by deleting one hydrogen atom therefrom. An alkyl group may be a linear, branched, cyclic or a combination thereof. Nonlimiting examples of suitable alkyls include methyl, ethyl, n-propyl, i-propyl, n-butyl, t-butyl, i-butyl (or 2-methylpropyl), etc. In an embodiment, the alkyl has from 1 to 8, or 12, or 20, or 22 carbon atoms.

An "alkylene" (also known as an "alkene"), is an unsaturated, aliphatic hydrocarbon with one or more carbon-carbon double bonds.

An "anion" is a negatively charged ion.

"Aryl" refers to an aromatic substituent which may be a single aromatic ring or multiple aromatic rings which are fused together, linked covalently, or linked to a common group such as a methylene or ethylene moiety. The aromatic ring(s) may include phenyl, naphthyl, anthracenyl, and biphenyl, among others. In particular embodiments, aryls have from 1 and 200 carbon atoms, from 1 and 50 carbon atoms, or from 1 and 20 carbon atoms.

An "arylene" is an aromatic hydrocarbon that has had a hydrogen atom removed from two ring carbon atoms. Nonlimiting examples of arylenes include o-phenylene and benzene-1,2-diyl.

The terms "blend" or "polymer blend," as used herein, is a blend of two or more polymers. Such a blend may or may not be miscible (not phase separated at molecular level). Such a blend may or may not be phase separated. Such a blend may or may not contain one or more domain configurations, as determined from transmission electron spectroscopy, light scattering, x-ray scattering, and other methods known in the art.

A "cation" is a positively charged ion.

The term "composition" refers to a mixture of materials which comprise the composition, as well as reaction products and decomposition products formed from the materials of the composition.

The terms "comprising," "including," "having" and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

An "externally stabilized polyurethane dispersion" is an emulsion containing polyurethane that does not have sufficient ionic or nonionic hydrophilic pendant groups on or within the polyurethane, and thus requires the addition of a surfactant (such as an anionic surfactant) to stabilize the polyurethane dispersion. Nonlimiting examples of externally stabilized polyurethane dispersions are described in U.S. Pat. Nos. 5,539,021; 5,688,842 and 5,959,027, each herein incorporated in its entirety by reference.

"Fabric" is a woven structure or a non-woven (such as knitted) structure formed from individual fibers or yarn.

"Fiber" and like terms refer to an elongated column of entangled filaments. Fiber diameter can be measured and reported in a variety of fashions. Generally, fiber diameter is measured in denier per filament. Denier is a textile term which is defined as the grams of the fiber per 9,000 meters of that fiber's length. Monofilament generally refers to an extruded strand having a denier per filament greater than 15, usually greater than 30. Fine denier fiber generally refers to fiber having a denier of 15 or less. Microdenier (aka microfiber) generally refers to fiber having a diameter not greater than 100 micrometers, or not greater than 10 micrometers.

A "fiber-entangled fabric" is formed from bonding fibers within a fibrous web. The fibrous web may be formed by carding, airlaying, or wet-laying. The bonds may be randomly formed via hydro-entanglement.

"Filament" and like terms refer to a single, continuous strand of elongated material having generally round cross-section and a length to diameter ratio of greater than 10.

A "hydrocarbon" is a compound that contains only hydrogen and carbon atoms. The hydrocarbon can be (i) branched or unbranched, (ii) saturated or unsaturated (iii) cyclic or acyclic, and (iv) any combination of (i)-(iii). Nonlimiting examples of hydrocarbons include alkanes, alkenes, and alkynes.

An "internally stabilized polyurethane dispersion" is an emulsion containing polyurethane that is stabilized through the incorporation of hydrophilic pendant groups (such as anionically hydrophilic pendant groups) on the polyurethane, which is dispersed in the liquid medium. Typically, dihydroxyalkylcarboxylic acids such as described by U.S. Pat. No. 3,412,054, incorporated in its entirety herein by reference, are used to make anionic internally stabilized polyurethane dispersions. A nonlimiting example of a suitable monomer used to make an anionic internally stabilized polyurethane dispersion is dimethylolpropionic acid (DMPA).

An "interpolymer" is a polymer prepared by the polymerization of at least two different monomers. This generic term includes copolymers, usually employed to refer to polymers prepared from two different monomers, and polymers prepared from more than two different monomers, e.g., terpolymers, tetrapolymers, etc.

A "knitted fabric" is formed from intertwining yarn or fibers in a series of connected loops either by hand, with knitting needles, or on a machine. The fabric may be formed by warp or weft knitting, flat knitting, and circular knitting. Nonlimiting examples of suitable warp knits include tricot, raschel powernet, and lacing. Nonlimiting examples of suitable weft knits include circular, flat, and seamless (which is often considered a subset of circular knits).

"Nonwoven" refers to a web or a fabric having a structure of individual fibers or threads which are randomly interlaid, but not in an identifiable manner as is the case of a knitted fabric. A nonlimiting example of a nonwoven fabric is fiber-entangled fabric.

An "olefin-based polymer" or "polyolefin" is a polymer that contains more than 50 weight percent polymerized olefin monomer (based on total amount of polymerizable monomers), and optionally, may contain at least one comonomer. A nonlimiting examples of an olefin-based polymer is ethylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

"Woven" refers to a web or a fabric having a structure of individual fibers or threads which are interlaid in a pattern in an identifiable manner. A nonlimiting example of a woven fabric is a knitted fabric.

"Yarn" is a continuous length of twisted or otherwise entangled filaments that can be used in the manufacture of woven or knitted fabrics.

TEST METHODS

Apparent density is calculated by diving the weight per area of a material by the thickness of the material, and is reported in grams per cubic centimeter (g/cc or g/cm$^3$). Weight per area is measured in accordance with ASTM D3776 and is reported in grams per square meter (g/m$^2$). Thickness is measured in accordance with ASTM D5729 and is reported in meters. For sea-island type composite spun fiber, apparent density is measured after dissolving and removing the sea component.

Average pore size is determined by measuring the area of about 100 pores randomly, using image analysis software on a scanning electron microscope (SEM) micrograph, such as Leica QWin software available from Leica Microsystems AG of Wetzlar, Germany, and calculating the mean average pore size.

Density is measured in accordance with ASTM D792, Method B. The result is recorded in grams per cubic centimeter (g/cc).

Handfeel is subjectively determined by a panel of five individuals. Each individual touches the sample surface with the pads of their fingers and rates the sample from 1 to 6, with 1 indicating a sample that feels very hard, 2 indicating a sample that feels hard, 3 indicating a sample that feels somewhat hard, 4 indicating a sample that feels somewhat soft, 5 indicating a sample that feels soft, and 6 indicating a sample that feels very soft. The average sample rating is reported.

Mean volume average particle size is measured using a Beckman Coulter LS 230 Light Scattering Particle Sizer, available from Beckman Coulter Corporation.

Viscosity is measured using a Brookfield Viscometer Model, and a Brookfield RV-DV-II-Pro viscometer spindle #62 under 30 rpm, at 25° C. for the polyurethane dispersion and at 25° C. for the cationic hydroxyethylcellulose solution.

Wrinkles are visually detected after a sample has been folded onto itself in a U-shape. Visual inspection with the naked eye is used to determine the presence of visible wrinkles at the bottom of the U-shape.

Gel Permeation Chromatography (GPC)

A high temperature gel permeation chromatography (GPC) system, equipped with Robotic Assistant Deliver (RAD) system is used for sample preparation and sample injection. The concentration detector is an Infra-red detector (IR-5) from Polymer Char Inc. (Valencia, Spain). Data collection is performed using a Polymer Char DM 100 Data acquisition box. The carrier solvent is 1,2,4-trichlorobenzene (TCB). The system is equipped with an on-line solvent degas device from Agilent. The column compartment is operated at 150° C. The columns are four Mixed A LS 30 cm, 20 micron columns. The solvent is nitrogen-purged 1,2,4-trichlorobenzene (TCB) containing approximately 200 ppm 2,6-di-t-butyl-4-methylphenol (BHT). The flow rate is 1.0 mL/min, and the injection volume is 200 μl. A "2 mg/mL" sample concentration is prepared by dissolving the sample in $N_2$ purged and preheated TCB (containing 200 ppm BHT), for 2.5 hours at 160° C., with gentle agitation.

The GPC column set is calibrated by running twenty narrow molecular weight distribution polystyrene standards. The molecular weight (MW) of the standards ranges from 580 g/mol to 8,400,000 g/mol, and the standards are contained in six "cocktail" mixtures. Each standard mixture has at least a decade of separation between individual molecular weights. The equivalent polypropylene molecular weights of each PS standard are calculated by using following equation, with reported Mark-Houwink coefficients for polypropylene (Th. G. Scholte, Meijerink, H. M. Schoffeleers, & A. M. G. Brands, J. Appl. Polym. Sci., 29, 3763-3782 (1984)) and polystyrene (E. P. Otocka, R. J. Roe, N. Y. Hellman, & P. M. Muglia, Macromolecules, 4, 507 (1971)):

$$M_{PP} = \left(\frac{K_{PS} M_{PS}^{a_{PS}+1}}{K_{PP}}\right)^{\frac{1}{a_{PP}+1}}, \quad \text{(Eq 1)}$$

where $M_{PP}$ is PP equivalent MW, $M_{PS}$ is PS equivalent MW, log K and α values of Mark-Houwink coefficients for PP and PS are listed below.

| Polymer | α | log K |
|---|---|---|
| Polypropylene | 0.725 | −3.721 |
| Polystyrene | 0.702 | −3.900 |

A logarithmic molecular weight calibration is generated using a fourth order polynomial fit as a function of elution volume. Number average and weight average molecular weights are calculated according to the following equations:

$$M_n = \frac{\sum^i Wf_i}{\sum^i (Wf_i / M_i)}, \quad \text{(Eq 2)}$$

$$M_w = \frac{\sum^i (Wf_i * M_i)}{\sum^i (Wf_i)}, \quad \text{(Eq 3)}$$

where $Wf_i$ and $M_i$ are the weight fraction and molecular weight of elution component i, respectively.

DETAILED DESCRIPTION

The present disclosure provides a process. The process includes (i) first, contacting a textile with an aqueous solution containing a cationic hydroxyethylcellulose polymer to form a modified textile component; (ii) subsequently, impregnating the modified textile component with an aqueous polyurethane dispersion, the aqueous polyurethane dispersion including a second surfactant; and (iii) precipitating the polyurethane in the modified textile component.

The present disclosure provides another process. The process includes (i) first, contacting a textile with an aqueous solution containing a cationic hydroxyethylcellulose polymer to form a modified textile component; (ii) subsequently, impregnating the modified textile component with an aqueous polyurethane dispersion externally stabilized with an anionic surfactant, the aqueous polyurethane dispersion including a second surfactant; and (iii) precipitating the polyurethane in the modified textile component.

In an embodiment, the process includes (iv) forming a synthetic leather.

(1) Contacting a Textile with an Aqueous Solution

The process includes the step of contacting a textile with an aqueous solution containing a cationic hydroxyethylcellulose polymer to form a modified textile component.

A. Textile

A textile is contacted with an aqueous solution containing a cationic hydroxyethylcellulose polymer. A "textile" is a flexible material composed of a network of natural fibers, artificial fibers, and combinations thereof. Textile includes fabric and cloth. The textile may be woven or nonwoven. In an embodiment, the textile is a nonwoven textile. A nonlimiting example of a nonwoven textile is a fiber-entangled textile. Nonlimiting examples of artificial fibers include polyesters, polyamides, acrylics, polyolefins, polyvinyl chlorides, polyvinylidene chlorides, polyvinyl alcohols, and combinations thereof. Nonlimiting examples of suitable natural fibers include cotton, wool, hemp, and combinations thereof. In an embodiment, the textile is a nonwoven textile containing polyamide/polyethylene fibers.

In an embodiment, the textile is a microfiber nonwoven textile. A "microfiber" textile is a fabric containing fiber having a diameter not greater than 100 micrometers, or not greater than 10 micrometers.

In an embodiment, the textile is a sea-island type composite spun fiber containing fibers formed from (i) an island component polymeric material and (ii) a sea component polymeric material. The island component can be converted to a microfine form by dissolving and removing the sea component with an organic solvent, an alkali solution, water, or a combination thereof, thereby forming a microfiber textile.

In an embodiment, the textile has an apparent density from 0.10 g/cc, or 0.20 g/cc, or 0.25 g/cc to 0.27 g/cc, or 0.30 g/cc, or 0.31 g/cc, or 0.32 g/cc, or 0.35 g/cc, or 0.40 g/cc, or 0.50 g/cc.

In an embodiment, the textile contains fibers having a size from 0.1 denier, or 0.3 denier, or 1 denier, or 2 denier, or 3 denier to 4 denier, or 5 denier, or 6 denier, or 7 denier, or 8 denier, or 9 denier, or 10 denier. In another embodiment, the textile contains fibers having a size equal to or less than 10 denier.

In an embodiment, the textile has a thickness from 0.5 mm, or 1.0 mm to 1.5 mm, or 2.0 mm.

In an embodiment, the textile is a nonwoven textile having one, some, or all of the following properties:

(a) an apparent density from 0.10 g/cc, or 0.20 g/cc, or 0.25 g/cc to 0.32 g/cc, or 0.35 g/cc; and/or (b) a fiber size from 1 denier, or 3 denier to 5 denier; and/or (c) a thickness from 0.5 mm, or 1.0 mm to 1.5 mm, or 2.0 mm.

The textile may comprise two or more embodiments disclosed herein.

B. Aqueous Solution

The process includes contacting the textile with an aqueous solution containing a cationic hydroxyethylcellulose polymer. A "cationic hydroxyethylcellulose polymer" (or "CH Polymer") is a hydroxyethylcellulose polymer having a cationic group bound to its polymeric backbone. Nonlimiting examples of suitable cationic groups that are bound to the hydroxyethylcellulose polymer's polymeric backbone include a quaternary ammonium cation group and a quaternary phosphonium cation group. The CH Polymer is water soluble.

A "quaternary ammonium cation group" is a positively charged molecular ion of the Structure (1):

Structure (1)

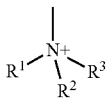

wherein $R^1$, $R^2$, and $R^3$ each is independently selected from an alkyl group or an aryl group. In an embodiment, $R^1$, $R^2$, and $R^3$ of Structure (1) each is an alkyl group. In a further embodiment $R^1$, $R^2$, and $R^3$ of Structure (1) each is a $C_1$-$C_{10}$, or a $C_1$-$C_8$, or a $C_1$-$C_4$ alkyl group. In a further embodiment, $R^1$, $R^2$, and $R^3$ of Structure (1) each is a methyl group. The quaternary ammonium cation group is covalently bonded to the hydroxyethylcellulose polymer's polymeric backbone.

A "quaternary phosphonium cation group" is a positively charged molecular ion of the Structure (2):

Structure (2)

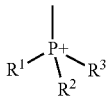

wherein $R^1$, $R^2$, and $R^3$ each is independently selected from an alkyl group or an aryl group. In an embodiment, $R^1$, $R^2$, and $R^3$ of Structure (2) each is an alkyl group. In a further embodiment, $R^1$, $R^2$, and $R^3$ of Structure (2) each is a $C_1$-$C_{20}$, or a $C_1$-$C_8$, or a $C_1$-$C_4$ alkyl group. In a further embodiment, $R^1$, $R^2$, and $R^3$ of Structure (2) each is a methyl group. The quaternary phosphonium cation group is covalently bonded to the hydroxyethylcellulose polymer's polymeric backbone.

In an embodiment, the aqueous solution contains a CH Polymer with a quaternary ammonium cation group. In a further embodiment, the aqueous solution contains a CH Polymer with a quaternary ammonium cation group, the CH Polymer having the following Structure (A):

Structure (A)

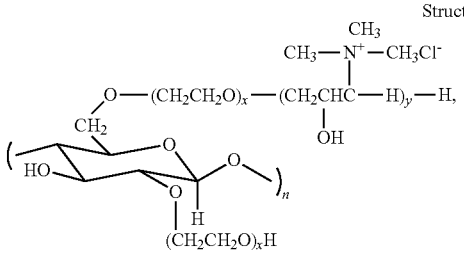

wherein n refers to the number of repeating units of the cationic hydroxyethylcellulose;

x refers to the number of repeating units of ethylene oxide ($CH_7CH_2O$); and y refers to the number of repeating units of quaternary ammonium cation group.

In an embodiment, n of Structure (A) is a positive integer from 200 to 10,000.

In an embodiment, x of Structure (A) is an integer from 0 to 30.

In an embodiment, y of Structure (A) is a positive integer from 1 to 10.

In an embodiment, in Structure (A):

n is a positive integer from 200 to 10,000;

x is an integer from 0 to 30, or from 1 to 30; and y is a positive integer from 1 to 10.

Nonlimiting examples of suitable CH Polymers with a quaternary ammonium cation group with Structure (A) include those sold under the trade name UCARE™ JR, available from The Dow Chemical Company, including UCARE™ JR 125, UCARE™ JR 400, and UCARE™ JR 30M.

In an embodiment, the CH Polymer has a weight average molecular weight (Mw) from 100,000 Daltons, or 250,000 Daltons, or 500,000 Daltons, or 1,000,000 Daltons to 2,000,000 Daltons, or 3,000,000 Daltons. Not wishing to be bound by any particular theory, it is believed that a CH Polymer with a Mw higher than 3,000,000 Daltons would be too slow to disperse in the aqueous medium to exhibit greater coalescence. In other words, a CH Polymer with a Mw greater than 3,000,000 Daltons will be too slow to dispersion in the aqueous medium, which results in ineffective precipitation of the polyurethane. In another embodiment, the CH Polymer has a Mw from 100,000 Daltons, or 250,000 Daltons, or 290,000 Daltons to 900,000 Daltons, or 1,000,000 Daltons.

In an embodiment, the CH Polymer contains from 0.5 wt %, or 1.0 wt %, or 1.5 wt % to 2.2 wt %, or 2.5 wt %, or 3.0 wt %, or 5.0 wt % nitrogen, based on the total weight of the CH Polymer. In a further embodiment, the CH Polymer contains from 1.5% to 2.2 wt % nitrogen, based on the total weight of the CH Polymer.

In an embodiment, an aqueous solution containing 2 wt % CH Polymer has a viscosity from 50 cP, or 75 cP, or 100 cP, or 200 cP, or 300 cP to 500 cP, or 1,000 cP, or 5,000 cP, or 10,000 cP, or 20,000 cP, or 30,000 cP, or 35,000 cP.

In an embodiment, the aqueous solution contains from 0.20 wt %, or 0.25 wt %, or 0.40 wt %, or 0.50 wt %, or 0.60 wt % to 0.80 wt %, or 0.90 wt %, or 1.00 wt %, or 1.20 wt %, or 1.50 wt %, or 2.0 wt %, or 3.0 wt % of the CH Polymer. Weight percent is based on the total weight of the aqueous solution.

In an embodiment, the aqueous solution contains, consists essentially of, or consists of, from 0.20 wt %, or 0.25 wt %, or 0.40 wt %, or 0.50 wt %, or 0.60 wt % to 0.80 wt %, or 0.90 wt %, or 1.00 wt %, or 1.20 wt %, or 1.50 wt %, or 2.0 wt %, or 3.0 wt % of the CH Polymer; and a reciprocal amount of water, or from 97 wt %, or 98 wt %, or 98.50 wt %, or 98.80 wt %, or 99.00 wt %, or 99.10 wt %, or 99.20 wt % to 99.40 wt %, or 99.50 wt %, or 99.60 wt %, or 99.70 wt %, or 99.75 wt %, or 99.80 wt % water, based on the total weight of the aqueous solution.

The aqueous solution may optionally contain an additive. A nonlimiting example of a suitable additive is a softening agent, such as silicone oil.

In an embodiment, the aqueous solution consists essentially of the CH Polymer and water. In another embodiment, the aqueous solution consists of the CH Polymer and water.

In an embodiment, the process includes selecting an aqueous solution having one, some, or all of the following properties:

(a) the CH Polymer has a Mw from 100,000 Dalton, or 250,000 Dalton, or 500,000 Dalton, or 1,000,000 Dalton to 2,000,000 Dalton, or 3,000,000 Dalton; and/or (b) the CH Polymer contains from 0.5 wt %, or 1.0 wt %, or 1.5 wt % to 2.2 wt %, or 2.5 wt %, or 3.0 wt %, or 5.0 wt % nitrogen; and/or (c) a viscosity from 50 cP, or 75 cP, or 100 cP, or 200 cP, or 300 cP to 500 cP, or 1,000 cP, or 5,000 cP, or 10,000 cP, or 20,000 cP, or 30,000 cP, or 35,000 cP, when measured in an aqueous solution containing 2 wt % of the CH Polymer.

It is understood that the sum of the components in each of the aqueous solutions disclosed herein, including the foregoing aqueous solution, yields 100 wt %.

In an embodiment, the aqueous solution excludes free inorganic salts. A "free" salt is a salt compound that is not bound to a polymeric backbone. Free inorganic salts, such as NaCl and $Ca(NO_3)_7$, are problematic because they form pollutants in waste water. By excluding free inorganic salts, the present process advantageously avoids the need for waste water treatment to remove pollutants.

The aqueous solution is void of, or substantially void of organic solvents. An "organic solvent" is an organic compound that can dissolve a solute and displays a heightened flammability and vapor pressure (i.e., greater than 0.1 mm of Hg), such as dimethyl formamide (IMF).

The textile is contacted with the aqueous solution to form a modified textile component. A "modified textile component" is a textile with fibers that are in contact with the CH Polymer.

Nonlimiting examples of suitable procedures for contacting the textile with aqueous solution of CH Polymer include dipping, immersing, brushing, spraying or doctor blading. In an embodiment, the textile is immersed in the aqueous solution. In a further embodiment, the textile is immersed in the aqueous solution for a duration from 30 seconds, or 1 minute to 90 seconds, or 2 minutes, or 5 minutes, or 10 minutes, the aqueous solution having a temperature from 20° C., or 23° C. to 25° C., or 30° C.

After the contacting, the modified textile component may contain excess aqueous solution or water. In an embodiment, excess aqueous solution or water are removed from the modified textile component by passing the modified textile component through rollers, such as rubber rollers, optionally while also exposed to drying at elevated temperature (greater than ambient temperature). In an embodiment, after the contacting, the modified textile component is passed through a two-roller machine, through an impregnation padder, or is hand-rolled. Not wishing to be bound by any particular theory, it is believed that the rollers/padder also facilitate homogenous penetration of the aqueous solution into the textile, such that all, or substantially all, of the fibers of the textile are contacted with the aqueous solution.

In an embodiment, after the contacting, the modified textile component is dried in an oven. The modified textile component is dried in an oven at a temperature from 70° C., or 80° C., or 90° C. to 100° C., or 110° C., or 120° C., or 150° C. for a duration from 1 minute, or 5 minutes, or 10 minutes, or 15 minutes to 20 minutes, or 30 minutes, or 40 minutes, or 60 minutes. The drying removes all, or substantially all, of the water from the modified textile component.

In an embodiment, before the drying, the modified textile component contains from 25 wt %, or 28 wt %, or 30 wt %, or 35 wt %, or 40 wt %, or 44 wt %, or 45 wt %, or 50 wt % to 72 wt %, or 75 wt %, or 80 wt % of the aqueous solution, based on the total weight of the modified textile component.

The contacting step may comprise two or more embodiments disclosed herein.

(2) Impregnating the Modified Textile Component with an Aqueous Polyurethane Dispersion and Precipitating the Polyurethane in the Modified Textile Component The process includes impregnating the modified textile component with an aqueous polyurethane dispersion, the aqueous polyurethane dispersion including a second surfactant. In an embodiment, the process includes impregnating the modified textile component with an aqueous polyurethane dispersion externally stabilized with an anionic surfactant, the aqueous polyurethane dispersion including a second surfactant.

The process includes precipitating the polyurethane in the modified textile component.

A. Aqueous Polyurethane Dispersion

The modified textile component is impregnated with an aqueous polyurethane dispersion that includes a second surfactant.

An "aqueous polyurethane dispersion" (or "PUD") is an emulsion containing polyurethane particles, an anionic moiety, water, and a second surfactant. The PUD may be an internally stabilized PUD or an externally stabilized PUD.

In an embodiment, the PUD is an internally stabilized PUD. In an internally stabilized PUD, the anionic moiety is incorporated within the polyurethane polymeric backbone.

Nonlimiting examples of suitable monomers having anionic moieties include aliphatic, cycloaliphatic, araliphatic, or aromatic carboxylic acids and sulfonic acids that include at least one alcoholic hydroxyl group or at least one primary or secondary amino group. A nonlimiting example of a suitable monomer having an anionic moiety is dimethylolpropionic acid (DMPA). A nonlimiting example of a PUD that is internal stabilized with DMPA is Primal™ U-51, available from The Dow Chemical Company.

In an embodiment, the PUD is an externally stabilized PUD. In an externally stabilized PUD, the anionic moiety is incorporated into the dispersion as an anionic surfactant. Nonlimiting examples of suitable anionic surfactants include sulfonates, sulfates, and carboxylates. In an embodiment, the PUD is externally stabilized with a sulfonate surfactant. A nonlimiting example of a PUD that is externally stabilized with a sulfonate surfactant is SYNTEGRA™ YS3000, available from The Dow Chemical Company.

The aqueous polyurethane dispersion is void of, or substantially void of, organic solvents. In an embodiment, the PUD contains from 0 wt %, or greater than 0 wt %, or 0.1 wt %, or 0.3 wt % to 0.5 wt %, or 1 wt % organic solvent, based on the total weight of the PUD. It is understood that the PUD may or may not include residual organic solvent from the PU synthesis. In an embodiment, the PUD has no detectable organic solvent present (i.e., "void" of an organic solvent).

In an embodiment, the PUD is prepared by reacting a polyurethane/urea/thiourea prepolymer (hereafter referred to as "prepolymer") with a chain-extending reagent in an aqueous medium and in the presence of a stabilizing amount of an external anionic surfactant. The polyurethane/urea/thiourea prepolymer is prepared by contacting a high molecular weight organic compound having at least two active hydrogen atoms with a polyisocyanate, and under such conditions to ensure that the prepolymer is terminated with at least two isocyanate groups.

In an embodiment, the polyisocyanate is an organic diisocyanate, and may be aromatic, aliphatic, or cycloaliphatic, or a combination thereof. Nonlimiting examples of suitable diisocyanates include those disclosed in U.S. Pat. No. 3,294,724, column 1, lines 55 to 72, and column 2, lines 1 to 9, incorporated herein by reference, as well as U.S. Pat. No. 3,410,817, column 2, lines 62 to 72, and column 3, lines 1 to 24, also incorporated herein by reference. Nonlimiting examples of suitable organic diisocyanate include 4,4'-diisocyanatodiphenylmethane, 2,4'-diisocyanatodiphenylmethane, isophorone diisocyanate, p-phenylene diisocyanate, 2,6 toluene diisocyanate, polyphenyl polymethylene polyisocyanate, 1,3-bis(isocyanatomethyl)cyclohexane, 1,4-diisocyanatocyclohexane, hexamethylene diisocyanate, 1,5-naphthalene diisocyanate, 3,3'-dimethyl-4,4'-biphenyl diisocyanate, 4,4'-diisocyanatodicyclohexylmethane, 2,4'-diisocyanatodicyclohexylmethane, and 2,4-toluene diisocyanate, or combinations thereof.

An "active hydrogen group" is a group that reacts with an isocyanate group to form a urea group, a thiourea group, or a urethane group as illustrated by the general reaction:

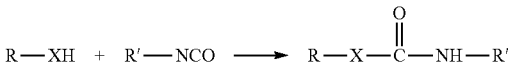

where X is O, S, NH, or N; and

R and R' are connecting groups that may be aliphatic, aromatic, cycloaliphatic, or combinations thereof.

The "high molecular weight organic compound" with at least two active hydrogen atoms is an organic compound with a weight average molecular weight (Mw) of at least 500 Daltons. The high molecular weight organic compound having at least two active hydrogen atoms may be a polyol (e.g, diol), a polyamine (e.g., diamine), a polythiol (e.g., dithiol), or a mixture thereof (e.g., an alcohol-amine, a thiol-amine, or an alcohol-thiol). The polyol, polyamine, or polythiol compound may be primarily a dial, trial, or polyol having greater active hydrogen functionality, or a mixture thereof. It is understood that these mixtures may have an overall active hydrogen functionality that is slightly below 2, for example, due to a small amount of monol in a polyol mixture.

In an embodiment, the high molecular weight organic compound having at least two active hydrogen atoms is a polyalkylene glycol ether, or thioether, or polyester polyol, or polythiol having the general Structure (B):

Structure (B)

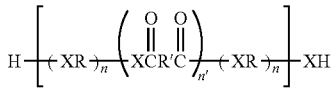

where each R is independently an alkylene radical; R' is an alkylene or an arylene radical; each X is independently S or O; and n and n' each is a positive integer.

In an embodiment, the NCO:XH ratio, where X is O or S, is from 1.1:1, or 1.2:1 to 5:1.

In an embodiment, the high molecular weight organic compound having at least two active hydrogen atoms has a weight average molecular weight (Mw) of at least 500 Daltons, or from 500 Daltons, or 750 Daltons, or 1,000 Daltons to 3,000 Daltons, or 5,000 Daltons, or 10,000 Daltons, or 20,000 Daltons.

In an embodiment, the high molecular weight organic compound having at least two active hydrogen atoms is a polyalkylene ether glycol or a polyester polyol. Nonlimiting examples of suitable polyalkylene ether glycols are polyethylene ether glycols, poly-1,2-propylene ether glycols, polytetramethylene ether glycols, poly-1,2-dimethylethylene ether glycols, poly-1,2-butylene ether glycol, and polydecamethylene ether glycols. Nonlimiting examples of suitable polyester polyols include polybutylene adipate, caprolactone based polyester polyol, and polyethylene terephthalate (PET).

The polyurethane prepolymer may be prepared by a batch process or a continuous process. In an embodiment, a stoichiometric excess of a diisocyanate and a polyol can be introduced in separate streams into a static or an active mixer at a temperature suitable for controlled reaction of the reagents, typically from 40° C. to 100° C. A catalyst may be used to facilitate the reaction of the reagents, such as an organotin catalyst (e.g., stannous octoate). The reaction is generally carried to substantial completion in a mixing tank to form the prepolymer. In an embodiment, the PUD is prepared as disclosed in U.S. Pat. No. 5,539,021, column 1, lines 9 to 45, the entire content of which is herein incorporated by reference.

When making PUD, the prepolymer may be extended by water solely, or may be extended using a chain extender, such as those known in the art. The chain extender may be any isocyanate reactive diamine or amine having another isocyanate reactive group and a molecular weight of from 60 g/mol to 450 g/mol. In an embodiment, the chain extender is selected from an aminated polyether diol; piperazine, aminoethylethanolamine, ethanolamine, ethylenediamine and mixtures thereof. In an embodiment, the amine chain extender is dissolved in the water used to make the dispersion.

The external stabilizing surfactant is an anionic surfactant. Nonlimiting examples of suitable anionic surfactants include sulfonates, phosphates, carboxylates, and combinations thereof. In an embodiment, the anionic surfactant is a sulfonate, such as sodium dodecyl benzene sulfonate, sodium dodecyl sulfonate, sodium dodecyl diphenyl oxide disulfonate, sodium n-decyl diphenyl oxide disulfonate, isopropylamine dodecylbenzenesulfonate, and sodium hexyl diphenyl oxide disulfonate. In a further embodiment, the anionic surfactant is sodium dodecyl benzene sulfonate.

In an embodiment, a flowing stream containing the prepolymer is merged with a flowing stream containing water with sufficient shear to form the PUD. An amount of a stabilizing surfactant is also present, either in the stream containing the prepolymer, in the stream containing the water, or in a separate stream. The relative rates of the stream containing the prepolymer (R2) and the stream containing the water (R1) are preferably such that the polydispersity of the emulsion (the ratio of the volume average diameter and the number average diameter of the particles or droplets, or Dv/Dn) is less than 5, or less than 3, or less than 2, or less than 1.5, or less than 1.3; or the mean volume average particle size is less than 2 microns, or less than 1 micron, or less than 0.5 micron, or less than 0.3 micron. The PUD may be prepared in a continuous process without phase inversion or stepwise distribution of an internal phase into an external phase.

In an embodiment, the anionic surfactant is used as a concentrate in water. In this case, a stream containing the anionic surfactant is first merged with a stream containing the prepolymer to form a prepolymer/surfactant mixture. The PUD can be prepared in this single step. In another embodiment, a stream containing the prepolymer and the anionic surfactant can be merged with a water stream to dilute the anionic surfactant and to create the PUD.

Second Surfactant

The PUD includes a second surfactant. The second surfactant is different than the anionic surfactant used to externally stabilize the PUD.

Nonlimiting examples of suitable second surfactants include zwitterionic surfactants, nonionic surfactants, and combinations thereof.

In an embodiment, the second surfactant is a zwitterionic surfactant. A "zwitterionic surfactant" is a molecule that lowers the surface tension between two liquids, or between a liquid and a solid, in which both a cationic group and an anionic group are bonded to the same molecule. Nonlimiting examples of suitable cationic groups include primary amine cations, secondary amine cations, tertiary amine cations, and quaternary ammonium cations. Nonlimiting examples of suitable anionic groups include phosphate anions and carboxylate anions. In an embodiment, the zwitterionic surfactant is a betaine. A "betaine" is a natural compound with (I) a positively charged cationic functional group, such as a quaternary ammonium or phosphonium cation (e.g., onium ions) that bears no hydrogen atom, and (ii) a negatively charged functional group, such as a carboxylate group, that may or may not be adjacent to the cationic site.

In an embodiment, the betaine is cocamidopropyl betaine. Cocamidopropyl betaine contains a quaternary ammonium cation and a carboxylate anion. Cocamidopropyl betaine is commercially available as STANFAX™ 590, from Royal Adhesives & Sealants.

In an embodiment, the second surfactant is a nonionic surfactant. A "nonionic surfactant" is a molecule that lowers the surface tension between two liquids, or between a liquid and a solid, in which oxygen-containing hydrophilic groups are bonded to a hydrophobic backbone. A nonlimiting example of a suitable nonionic surfactant is an alkyl polyglucoside. In an embodiment, the alkyl polyglucoside has the following Structure (3):

Structure (3)

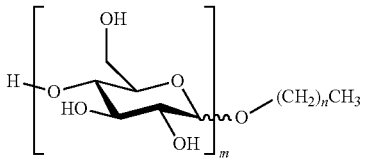

wherein m is from 1 to 5; and n is from 1 to 30.

A nonlimiting example of a suitable alkyl polyglucoside of Structure (3) is TRITON™ CG-600, available from The Dow Chemical Company.

In an embodiment, the second surfactant is selected from a betaine, an alkyl polyglucoside, and combinations thereof.

In an embodiment, the second surfactant is water soluble.

In an embodiment, the second surfactant is not soluble in water.

The second surfactant is dissolved, or substantially dissolved, in the PUD. In an embodiment, the second surfactant is completely dissolved in the PUD at room temperature (25° C.). The second surfactant is dissolved in the PUD before the modified textile component is impregnated with the PUD.

The second surfactant may comprise two or more embodiments disclosed herein

Optional Additive

The PUD may optionally contain an additive. Nonlimiting examples of suitable additives include rheological modifiers such as a thickeners; fillers, UV stabilizers, deformers, crosslinking agents, acrylic latex, and polyolefin latex. When the PUD contains another polymer such as an acrylic latex or a polyolefin latex, a dried film formed from the PUD contains at least 30 volume percent polyurethane, based on the total volume of the dried film.

In an embodiment, the PUD has a solids content from 5 wt %, or 10 wt %, or 11 wt %, or 15 wt %, or 20 wt %, or 21 wt % to 30 wt %, or 40 wt %, or 50 wt %, or 55 wt %, or 60 wt %, or 65 wt %, based on the total weight of the PUD. In another embodiment, the PUD has a solids content from 30 wt %, or 40 wt %, or 45 wt %, 50 wt %, or 53 wt % to 56 wt %, or 60 wt %, based on the total weight of the PUD.

In an embodiment, the PUD contains from 0.5 wt %, or 1.0 wt %, or 1.5 wt % to 2.0 wt %, or 2.5 wt %, or 3.0 wt %, or 3.5 wt %, or 4.0 wt %, or 4.5 wt %, or 5.0 wt % second surfactant, based on the total weight of the PUD. In another embodiment, the PUD contains from 0.5 wt % to 5.0 wt %, or from 1.0 to 3.0 wt % second surfactant, based on the total weight of the PUD.

In an embodiment, the PUD has a viscosity at 25° C. from 50 cP, or 100 cP, or 150 cP, or 200 cP, or 300 cP, or 400 cP, or 500 cP, or 550 cP to 570 cP, or 600 cP, or 700 cP, or 800 cP, or 900 cP, or 1,000 cP, or 5,000 cP, or 10,000 cP.

In an embodiment, the PUD has a density from 0.99 g/cc, or 1.00 g/cc, or 1.05 g/cc to 1.10 g/cc, or 1.20 g/cc, or 1.30 g/cc.

In an embodiment, the PUD has a mean volume average particle size from 100 nm, or 250 nm, or 300 nm, or 350 nm, or 370 nm to 380 nm, or 400 nm, or 450 nm, or 800 nm.

In an embodiment, the process includes selecting a sulfonate surfactant as the anionic surfactant. In a further embodiment, process includes selecting a PUD that is a polyether based aqueous polyurethane dispersion that is externally stabilized with a sulfonate surfactant. In a further embodiment, the process includes selecting a second surfactant that is a zwitterionic surfactant or a nonionic surfactant. The PUD has one, some, or all of the following properties:

(a) a solids content from 10 wt %, or 11 wt %, or 15 wt %, or 20 wt %, or 21 wt %, or 30 wt %, or 35 wt % to 40 wt %, or 50 wt %, or 55 wt %, or 60 wt %; and/or (b) a second surfactant content from 0.5 wt %, or 1.0 wt %, or 1.5 wt % to 2.0 wt %, or 2.5 wt %, or 3.0 wt %, or 3.5 wt %, or 4.0 wt %, or 4.5 wt %, or 5.0 wt %; and/or (c) a viscosity at 25° C. from 50 cP, or 100 cP, or 150 cP, or 200 cP, or 300 cP, or 400 cP, or 500 cP, or 550 cP to 570 cP, or 600 cP, or 700 cP, or 800 cP, or 900 cP, or 1,000 cP; and/or (d) a density from 0.99 g/cc, or 1.00 g/cc, or 1.05 g/cc to 1.10 g/cc, or 1.20 g/cc; and/or (e) a mean volume average particle size from 300 nm, or 350 nm, or 370 nm to 380 nm, or 400 nm; and/or (f) an organic solvent content of 0 wt %.

It is understood that the sum of the components in each of the PUDs disclosed herein, including the foregoing PUD, yields 100 wt %.

In an embodiment, the PUD excludes free inorganic salts.

The PUD may be mixed with other dispersions so long as the dispersion mixture is easily and quickly coagulated as described below. Other polymer dispersions or emulsions that may be useful when mixed with the PUD include polymers such as polyacrylates, polyisoprene, polyolefins, polyvinyl alcohol, nitrile rubber, natural rubber and copolymers of styrene and butadiene. In an embodiment, the PUD is used alone (i.e., not mixed with any other polymeric dispersion or emulsion).

The PUD may comprise two or more embodiments disclosed herein.

B. Impregnating and Precipitating

The present process includes impregnating the modified textile component with the PUD containing the second surfactant. The impregnation step occurs after the contacting step with the aqueous solution containing CH Polymer. Nonlimiting examples of suitable impregnation processes include dipping, immersing, brushing, spraying or doctor blading. In an embodiment, the modified textile component is immersed in the PUD. In a further embodiment, the modified textile component is immersed in the PUD for a duration from 30 seconds, or 1 minute to 90 seconds, or 2 minutes, or 5 minutes, or 10 minutes, the aqueous solution having a temperature from 20° C., or 23° C. to 25° C., or 30° C.

Not wishing to be bound by any particular theory, it is believed that by first contacting the textile with the aqueous solution containing a CH Polymer, the impregnation of the PUD is more homogenous throughout the textile because the anion group within the PUD is attracted to the cation group within the CH Polymer (which is present throughout the textile following the contacting step).

The present process includes precipitating the polyurethane in the modified textile component. During and/or after impregnation, the cationic group within the CH Polymer, and further within the modified textile component, reacts with the anionic group within the PUD to deactivate the surfactant and cause coagulation. In other words, the cationic group within the cationic hydroxyethylcellulose polymer and the anionic group within the PUD form an ionic pair to form a precipitate. For example, the quaternary ammonium cation group of the CH Polymer reacts with the anionic group of the PUD to stabilize (i.e., neutralize) the anionic charge of the surfactant in the PUD, resulting in the PUD losing its stability and precipitating the polyurethane.

The polyurethane is precipitated in and/or on the textile. Polyurethane that is "precipitated in" the textile is located between opposing surfaces of the textile. Polyurethane that is "precipitated on" the textile is located on a surface of the textile.

In an embodiment, the process includes precipitating the polyurethane in the textile during impregnation. In a further embodiment, the process includes precipitating the polyurethane in the textile during and after impregnation.

In an embodiment, during impregnation and any subsequent drying, the molar ratio of the cationic group within the CH Polymer and the anionic group within the PUD (i.e., the "Cation:Anion Ratio") is from 0.1, or 0.2 to 0.3, or 0.4, or 0.5, or 1.0, or 2, or 3, or 5, or 10. In a further embodiment, during impregnation and any subsequent drying, the Cation:Anion ratio is from 0.10 to 0.50, or from 0.10 to 0.30, or from 0.20 to 0.25. The "Cation:Anion ratio" is the ratio of the number of moles of cation groups (e.g., quaternary ammonium cation groups) to the number of moles of anion groups (e.g., from the anionic surfactant). Not wishing to be bound by any particular theory, it is believed that a Cation:Anion Ratio of less than 0.1 would cause insufficient coalescence. In other words, too few cation moieties will result in incomplete neutralization of the anion moieties. Incomplete neutralization of the anion moieties on the surfactant prevents the PUD from losing its stability, thereby preventing precipitation of the polyurethane. Additionally, it is believed that a Cation:Anion Ratio of greater than 10 would result in free CH Polymer (which is water soluble). The free CH Polymer would run off the textile with waste water, which must then be disposed.

The impregnating step may comprise two or more embodiments disclosed herein.

The precipitating step may comprise two or more embodiments disclosed herein.

(3) Forming a Synthetic Leather

In an embodiment, the process includes forming a synthetic leather.

A "synthetic leather" is a textile having fibers suspended within a porous polyurethane matrix. In other words, a synthetic leather has a porous polyurethane matrix that at least partially encapsulates, or fully encapsulates, the fibers of a textile. The polyurethane is located in the textile and on the textile surface. A synthetic leather is not naturally occurring in nature.

The synthetic leather has two opposing surfaces.

In an embodiment, after the impregnating, the synthetic leather is passed through a two-roller machine, through an impregnation padder, or is hand-rolled. Not wishing to be bound by any particular theory, it is believed that the rollers/padder facilitate homogenous penetration of the PUD into the modified textile component, such that the entire modified textile component is impregnated with the PUD. In other words, the PUD is impregnated throughout the entire thickness of the synthetic leather.

In an embodiment, after the impregnating, the synthetic leather is exposed to water. After impregnating, the textile is immersed in water at a temperature from 90° C., or 100° C. to 110° C. for a duration from 1 minute, or 2 minutes to 3 minutes, or 4 minutes, or 5 minutes, or 10 minutes, or 20 minutes. In another embodiment, after impregnating, the synthetic leather is exposed to steam at a temperature of 100° C. for a duration of from 1 minute, or 2 minutes to 3 minutes, or 4 minutes, or 5 minutes, or 10 minutes, or 20 minutes, or 30 minutes. Not wishing to be bound by any particular theory, it is believed that exposure to steam causes faster precipitation (i.e., coagulation) of the polyurethane into the modified textile component. Additionally, it is believed that exposure to steam aids in the impregnation of the PUD into the modified textile component.

In an embodiment, after the impregnating, the textile is exposed to a heated aqueous solution containing a cationic hydroxyethylcellulose polymer. The aqueous solution, and further the cationic hydroxyethylcellulose polymer may be any aqueous solution and CH Polymer disclosed herein. In a further embodiment, after impregnating, the textile is immersed in aqueous solution at from 90° C., or 100° C. to 110° C. for from 1 minute, or 2 minutes to 3 minutes, or 4 minutes, or 5 minutes, or 10 minutes, or 20 minutes. Not wishing to be bound by any particular theory, it is believed that exposure to a heated aqueous solution containing a cationic hydroxyethylcellulose polymer after the impregnating enables further precipitating of the polyurethane when complete precipitation is not accomplished during the impregnating.

In an embodiment, the synthetic leather is dried in an oven. In an embodiment, the synthetic leather is dried in an oven at a temperature from 80° C., or 90° C. to 100° C., or 110° C., or 120° C., or 130° C. for a duration of from 10 minutes, or 15 minutes to 20 minutes, or 30 minutes, or 40 minutes, or 60 minutes, or 70 minutes, or 90 minutes. The drying removes all, or substantially all of the water from the synthetic leather.

In an embodiment, the synthetic leather undergoes water washing, a softening treatment, and/or a coloring treatment.

In an embodiment, the textile is a sea-island type composite spun fiber containing fibers. The synthetic leather undergoes washing with an organic solvent, an alkali solution, water, or a combination thereof. The sea component is dissolved and removed, leaving microfibers formed from the island component.

In an embodiment, the synthetic leather contains from 5 wt %, or 6 wt %, or 15 wt %, or 16 wt %, or 20 wt %, or 30 wt %, or 40 wt %, or 50 wt % to 60 wt %, or 70 wt % polyurethane, based on the total weight of the synthetic leather. In another embodiment, the synthetic leather contains from 20 wt %, or 25 wt %, or 30 wt %, or 35 wt %, or 40 wt % to 45 wt %, or 50 wt %, or 60 wt %, or 70 wt % polyurethane, based on the total weight of the synthetic leather.

The synthetic leather has pores in the polyurethane matrix. A "pore" is a void volume within the polyurethane matrix. In an embodiment, the synthetic leather has an average pore size from 10 μm to 200 μm.

Not wishing to be bound by any particular theory, it is believed that dissolving the second surfactant in the PUD results in the water of the PUD becoming dispersed throughout the polyurethane matrix of the PUD. When the resulting synthetic leather is dried, the water evaporates to leave pores within the precipitated polyurethane. Handfeel is improved (i.e., made softer) by increasing the number of pores within the precipitated polyurethane and by having pores that are uniformly distributed throughout the precipitated polyurethane.

In an embodiment, the process includes forming a synthetic leather that exhibits a handfeel rating from 4, or 5 to 6.

In an embodiment, the process includes forming a synthetic leather that does not exhibit wrinkles after folding.

In an embodiment, the process includes forming a synthetic leather that exhibits a handfeel rating from 4, or 5 to 6; and not exhibit wrinkles after folding.

In an embodiment, the process includes forming a synthetic leather with a polyurethane matrix having pores, the synthetic leather having one or all of the following properties:

(a) contains from 20 wt %, or 30 wt %, or 40 wt %, or 50 wt % to 60 wt %, or 70 wt % polyurethane, based on the total weight of the synthetic leather; and/or
(b) an average pore size from 10 μm to 200 μm; and/or
(c) does not exhibit wrinkles after folding; and/or
(d) exhibits a handfeel rating from 4, or 5 to 6.

The forming a synthetic leather step may comprise two or more embodiments disclosed herein.

The process includes (i) first, contacting a textile with an aqueous solution containing, or consisting essentially of, or consisting of, a CH Polymer to form a modified textile component; (ii) subsequently, impregnating the modified textile component with an aqueous polyurethane dispersion externally stabilized with an anionic surfactant, the aqueous polyurethane dispersion including a second surfactant; (iii) precipitating the polyurethane in the modified textile component; and (iv) forming a synthetic leather. In other words, steps (i) and (ii) are performed sequentially, with step (i) performed to completion before step (ii) begins.

In an embodiment, the process includes:

(i) first, contacting a textile with an aqueous solution comprising a CH Polymer that is a hydroxyethylcellulose polymer with a quaternary ammonium cation group to form a modified textile component, wherein
  the textile is a nonwoven textile having one, some, or all of the following properties:
    (a) an apparent density from 0.10 g/cc, or 0.20 g/cc to 0.30 g/cc, or 0.35 g/cc; and/or
    (b) a fiber size from 1 denier, or 3 denier to 5 denier; and/or
    (c) a thickness from 0.5 mm, or 1.0 mm to 1.5 mm, or 2.0 mm;
  the aqueous solution has one, some, or all of the following properties:
    (a) the aqueous solution contains from 0.20 wt %, or 0.25 wt %, or 0.40 wt %, or 0.50 wt %, or 0.60 wt % to 0.80 wt %, or 0.90 wt %, or 1.00 wt %, or 1.20 wt %, or 1.50 wt %, or 2.0 wt %, or 3.0 wt % of the hydroxyethylcellulose polymer with a quaternary ammonium cation group, based on the total weight of the aqueous solution; and/or
    (b) the hydroxyethylcellulose polymer with a quaternary ammonium cation group has a Mw from 500,000 Daltons, or 1,000,000 Daltons to 2,000,000 Daltons, or 3,000,000 Daltons; and/or
    (c) the hydroxyethylcellulose polymer with a quaternary ammonium cation group contains from 0.5 wt %, or 1.0 wt %, or 1.5 wt % to 2.2 wt %, or 2.5 wt %, or 3.0 wt %, or 5.0 wt % nitrogen, based on the total weight of the hydroxyethylcellulose polymer with a quaternary ammonium cation group; and/or (d) the aqueous solution has a viscosity from 50 cP, or 75 cP, or 100 cP, or 200 cP, or 300 cP to 500 cP, or 1,000 cP, or 5,000 cP, or 10,000 cP, or 20,000 cP, or 30,000 cP, or 35,000 cP, when measured in an aqueous solution containing 2 wt % of the hydroxyethylcellulose polymer with a quaternary ammonium cation group;

(ii) subsequently, impregnating the modified textile component with an aqueous polyurethane dispersion externally stabilized with an anionic surfactant, the aqueous polyurethane dispersion containing a second surfactant, wherein the PUD externally stabilized with an anionic surfactant is a polyether based aqeuous polyurethane dispersion externally stabilized with a sulfonate surfactant;

the second surfactant is selected from a zwitterionic surfactant (such as a betaine) and a nonionic surfactant (such as an alkyl polyglucoside); and the PUD has one, some, or all of the following properties:

(a) a solids content from 10 wt %, or 11 wt %, or 15 wt %, or 20 wt %, or 21 wt %, or 30 wt %, or 35 wt % to 40 wt %, or 50 wt %, or 55 wt %, or 60 wt %, based on the total weight of the PUD; and/or (b) a second surfactant content from 0.5 wt %, or 1.0 wt %, or 1.5 wt % to 2.0 wt %, or 2.5 wt %, or 3.0 wt %, or 3.5 wt %, or 4.0 wt %, or 4.5 wt %, or 5.0 wt %; and/or (c) a viscosity at 25'C from 50 cP, or 100 cP, or 150 cP, or 200 cP, or 300 cP, or 400 cP, or 500 cP, or 550 cP to 570 cP, or 600 cP, or 700 cP, or 800 cP, or 900 cP, or 1,000 cP; and/or (d) a density from 0.99 g/cc, or 1.00 g/cc, or 1.05 g/cc to 1.10 g/cc, or 1.20 g/cc; and/or (e) a mean volume average particle size from 300 nm, or 350 nm, or 370 nm to 380 nm, or 400 nm; and/or (f) an organic solvent content of 0 wt %;

(iii) precipitating the polyurethane in the modified textile component; and (iv) forming a synthetic leather, wherein the synthetic leather has a polyurethane matrix containing pores and the synthetic leather has one, some, or all of the following properties:

(a) the synthetic leather contains from 20 wt %, or 30 wt %, or 40 wt % to 50 wt %, or 60 wt %, or 70 wt % polyurethane, based on the total weight of the synthetic leather; and/or (b) the synthetic leather has an average pore size from 10 μm to 200 μm; and/or (c) the synthetic leather contains a polyurethane matrix distributed throughout the thickness of the textile; and/or (d) the synthetic leather exhibits a uniform distribution of pores throughout the polyurethane matrix, and further throughout the synthetic leather; and/or (e) does not exhibit wrinkles after folding; and/or (f) exhibits a handfeel rating from 4, or 5 to 6; and steps (i) and (ii) are performed sequentially; and the process optionally includes one or more of the following steps:

passing the modified textile component through rollers; and/or removing water from the modified textile component before impregnating the modified textile component with the PUD; and/or removing water from the modified textile component by drying in an oven at a temperature from 70° C. to 120° C. for a duration of from 5 minutes to 60 minutes, before impregnating the modified textile component with the PUD; and/or passing the synthetic leather through rollers; and/or exposing the synthetic leather to steam at 100° C. for from 1 minute, or 2 minutes to 3 minutes, or 4 minutes, or 5 minutes, or 10 minutes, or 20 minutes, or 30 minutes; and/or removing water from the synthetic leather, such as by drying the synthetic leather in an oven at from 80° C., or 90° C. to 100° C., or 110° C., or 120° C., or 130° C. for from 10 minutes, or 15 minutes to 20 minutes, or 30 minutes, or 40 minutes, or 60 minutes, or 70 minutes, or 90 minutes; and/or maintaining a Cation:Anion Ratio from 0.1, or 0.2 to 0.3, or 0.4, or 0.5, or 1.0, or 10.

The present process may comprise two or more embodiments disclosed herein.

While the present disclosure is directed to a coagulation agent that is the CH Polymer in which a hydroxyethylcellulose polymer has a cationic group bound to its polymeric backbone, it is understood that the aqueous solution may alternatively contain a coagulation agent that includes a blend of a cellulose and a cationic ion, in which the cellulose and the cationic ion are not bound to one another.

The present disclosure also provides a synthetic leather produced by the present process.

The present synthetic leather is useful for applications such as clothing, accessories, purses, luggage, shoes, hats, automobile interiors, and furniture.

The synthetic leather may comprise two or more embodiments disclosed herein.

By way of example, and not limitation, some embodiments of the present disclosure will now be described in detail in the following Examples.

EXAMPLES

Materials used in the examples are provided in Table 1A below.

TABLE 1A

| Material/Description | Properties | Source |
|---|---|---|
| UCARE ™ JR 400 | hydroxyethylcellulose polymer with a quaternary ammonium cation group polyquaternium-10; viscosity (2 wt % aqueous solution) = 300-500 cP wt % Nitrogen = 1.5-2.2 wt %# | The Dow Chemical Company |
| SYNTEGRA ™ YS3000 | polyether based aqeuous polyurethane dispersion externally stabilized with sulfonate surfactant solids content = 54-55 wt %*; organic solvent content* = 0 wt % density = 1.05 g/cc; pH = 7.0-8.0; Viscosity (25° C.) = 150-500 cP; mean volume average particle size = 370 nm | The Dow Chemical Company |

TABLE 1A-continued

| Material/Description | Properties | Source |
|---|---|---|
| STANFAX ™ 590 | zwitterionic surfactant; cocamidopropyl betaine (CAS 61789-40-0) | Royal Adhesives & Sealants |
| TRITON ™ CG-600 | nonionic surfactant; alkyl polyglucoside | The Dow Chemical Company |
| Textile | nonwoven textile; containing co-spun polyamide/polyethylene fibers sea-island type; composite spun fiber; apparent density = 0.27 g/cm$^3$ fiber size = 4 denier; thickness = 1.2-1.8 mm | |

*Based on total weight of the dispersion

#Based on total weight of the hydroxyethylcellulose polymer with a quaternary ammonium cation group Comparative Sample 1 (CS 1)

A textile sample with a weight of 16.30 g is immersed for 1 minute in a PUD (SYNTEGRA™ YS3000) with a solids content of 54.5%, at room temperature (25° C.). After the textile is removed from the PUD, the textile is pressed with a Mathis impregnation padder. After impregnating, the textile is weighed. The textile contains 16.75 g PUD. The textile is then exposed to 100° C. steam for 15 minutes, and then dried in an oven for 15 minutes at 90° C. followed by 15 minutes at 120° C. After drying, the textile is weighed. The textile contains 9.13 g polyurethane.

The textile is then immersed in toluene at 90° C. for 1 hour to dissolve and remove the polyethylene sea component of the sea-island type composite co-spun fiber. The polyamide island component is formed into microfibers. The textile is dried in an oven for 15 minutes at 120° C.

The textile is hand-cut with a razor blade and the cross-sectional morphology of the impregnated textile is analyzed using an SEM micrograph.

FIG. 1 shows scanning electron microscope (SEM) micrographs of CS 1, at 500× magnification (left), 1000× magnification (center), and 2000× magnification (right).

Comparative Sample 2 (CS 2)

A PUD is prepared by dissolving 4.5 g STANFAX™ 590 in 300 g SYNTEGRA" YS3000 (solids content of 54.5%) at room temperature (25° C.). The PUD has a solids content of 54.2%.

A textile sample with a weight of 29.01 g is immersed for 1 minute in the PUD (SYNTEGRA™ YS3000 and STANFAX™ 590), at room temperature (25'C). The textile is removed from the PUD, the textile is pressed with a Werner Mathis AG, VFM 28888 two-roller machine. After rolling, the textile is weighed. The textile contains 19.59 g PUD. The textile is then dried in an oven for 15 minutes at 90° C. followed by 15 minutes at 120° C. After drying, the textile is weighed. The textile contains 10.15 g polyurethane.

The textile is then immersed in toluene at 90° C. for 1 hour to dissolve and remove the polyethylene sea component of the sea-island type composite co-spun fiber. The polyamide island component is formed into microfibers. The textile is dried in an oven for 15 minutes at 120° C.

The textile is hand-cut with a razor blade and the cross-sectional morphology of the impregnated textile is analyzed using an SEM micrograph.

Figure 2:
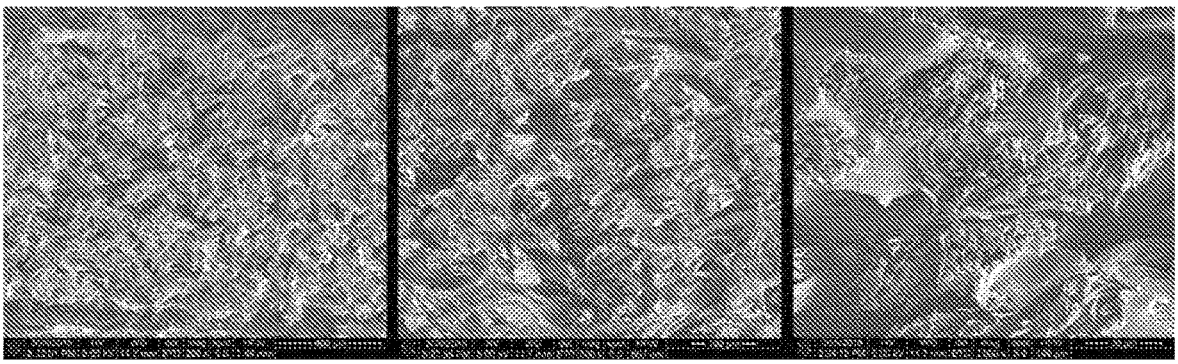
FIG. 2 shows SEM micrographs of Comparative Sample 2, at 200× magnification (left), 500× magnification (center), and 2000× magnification (right).

FIG. 2 shows SEM micrographs of CS 2, at 200× magnification (left), 500× magnification (center), and 2000× magnification (right).

Example 3 (Ex. 3)

A PUD is prepared by dissolving 3.0 g STANFAX™ 590 in 300 g SYNTEGRA™ Y53000 (solids content of 54.5%) at room temperature (25° C.). The PUD has a solids content of 54.4%.

A textile sample with a weight of 29.70 g is immersed for 1 minute in an aqueous solution containing 0.8 wt % UCARE™ JR 400 (based on the total weight of the aqueous solution) to contact the textile with the UCARE™ JR 400 solution to form a modified textile component. The aqueous solution is at room temperature (25° C.). After the modified textile component is removed from the UCARE™ JR 400 solution, the modified textile component is pressed with a Werner Mathis AG, VFM 28888 two-roller machine. The modified textile component is weighed. The modified textile component contains 33.08 g UCARE™ JR 400 solution. The modified textile component is then dried in an oven for 15 minutes at 90° C.

The dried modified textile component is immersed for 1 minute in the PUD (SYNTEGRA™ YS3000 and STANFAX™ 590), to impregnate the modified textile component with the PUD to form a synthetic leather. The PUD is at room temperature (25° C.). After the synthetic leather is removed from the PUD, the synthetic leather is pressed with a Werner Mathis AG, VFM 28888 two-roller machine. The synthetic leather is weighed. The synthetic leather contains 39.63 g PUD. The synthetic leather is then dried in an oven for 15 minutes at 90° C. followed by 15 minutes at 120° C. After drying, the synthetic leather is weighed. The synthetic leather contains 20.51 g polyurethane.

The synthetic leather is then immersed in toluene at 90° C. for 1 hour to dissolve and remove the polyethylene sea component of the sea-island type composite co-spun fiber. The polyamide island component is formed into microfibers. The synthetic leather is dried in an oven for 15 minutes at 120° C.

The synthetic leather is hand-cut with a razor blade and the cross-sectional morphology of the impregnated textile is analyzed using an SEM micrograph.

Figure 3:
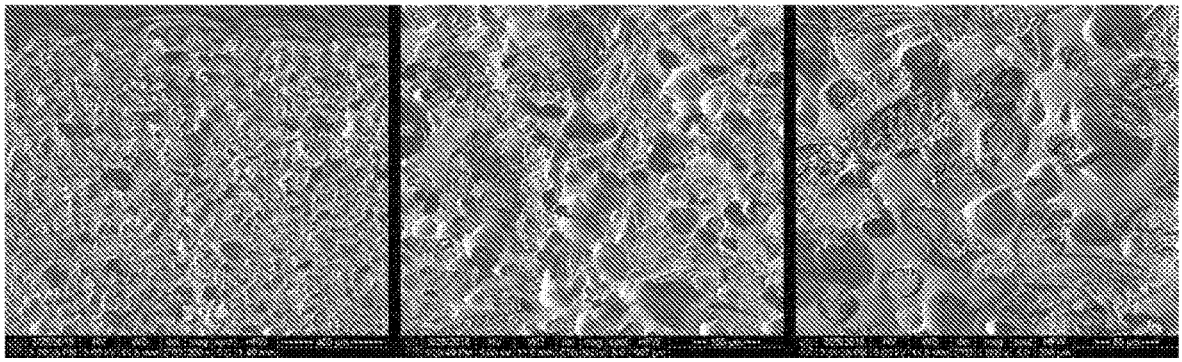
FIG. 3 shows SEM micrographs of Example 3, at 200× magnification (left), 500× magnification (center), and 2000× magnification (right).

FIG. 3 shows SEM micrographs of Example 3, at 200× magnification (left), 500× magnification (center), and 2000× magnification (right).

Examples 4-7 (Ex. 4-7)

Examples 4-7 are prepared in accordance with the procedures of Example 3 provided above. The components of the PUD and the aqueous solution for Examples 3-7 are provided in Table 1B below.

Figure 4:
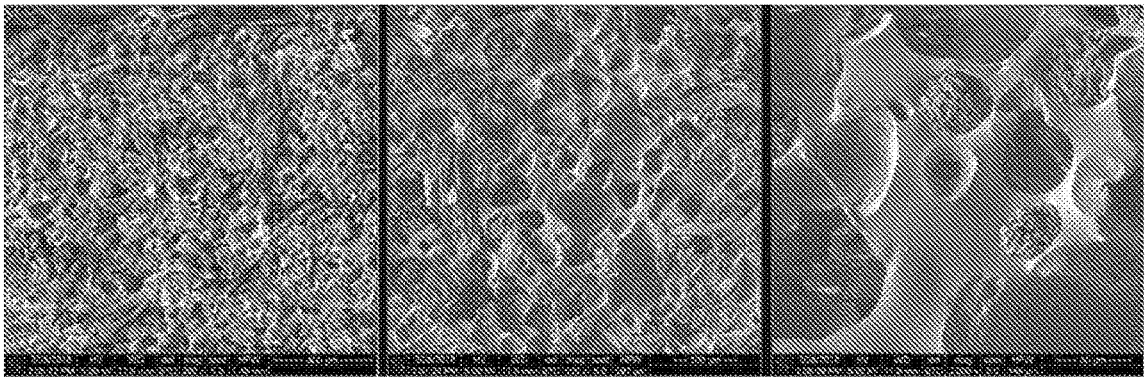
FIG. 4 shows SEM micrographs of Example 4, at 200× magnification (left), 500× magnification (center), and 2000× magnification (right).

FIG. 4 shows SEM micrographs of Example 4, at 200× magnification (left), 500× magnification (center), and 2000× magnification (right).

Figure 5:
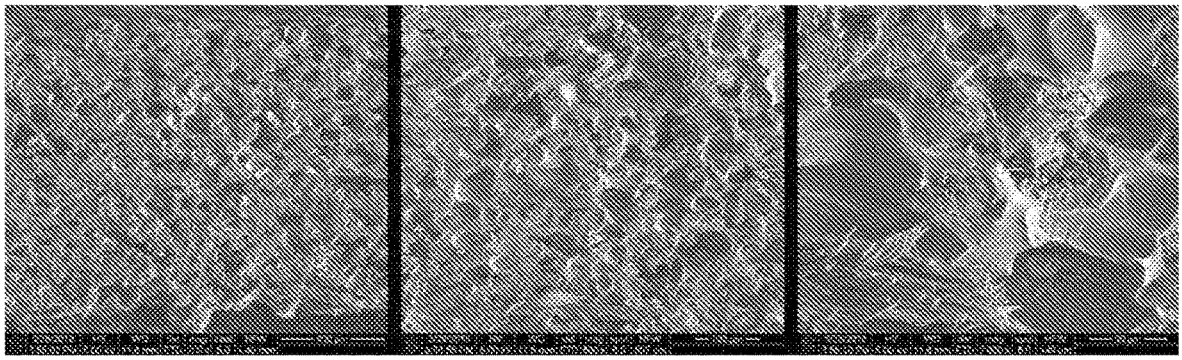
FIG. 5 shows SEM micrographs of Example 5, at 200× magnification (left), 500× magnification (center), and 2000× magnification (right).

FIG. 5 shows SEM micrographs of Example 5, at 200× magnification (left), 500× magnification (center), and 2000× magnification (right).

Figure 6:
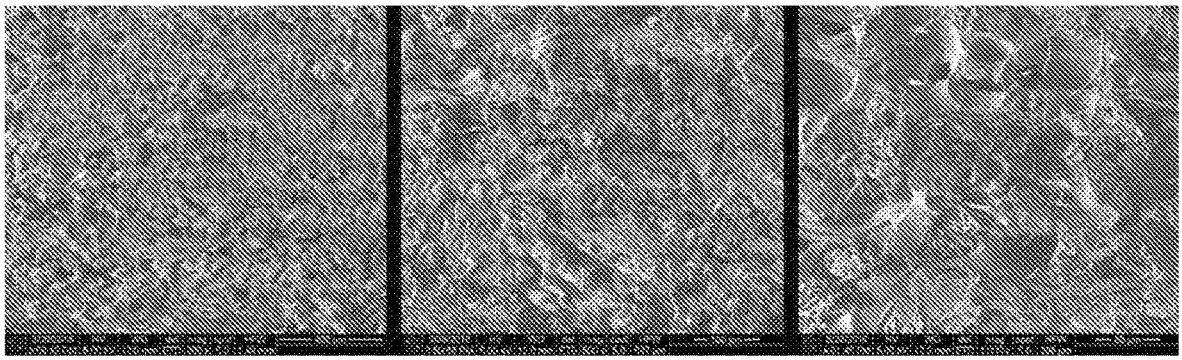
FIG. 6 shows SEM micrographs of Example 6, at 200× magnification (left), 500× magnification (center), and 1000× magnification (right).

FIG. 6 shows SEM micrographs of Example 6, at 200× magnification (left), 500× magnification (center), and 1000× magnification (right).

Figure 7:
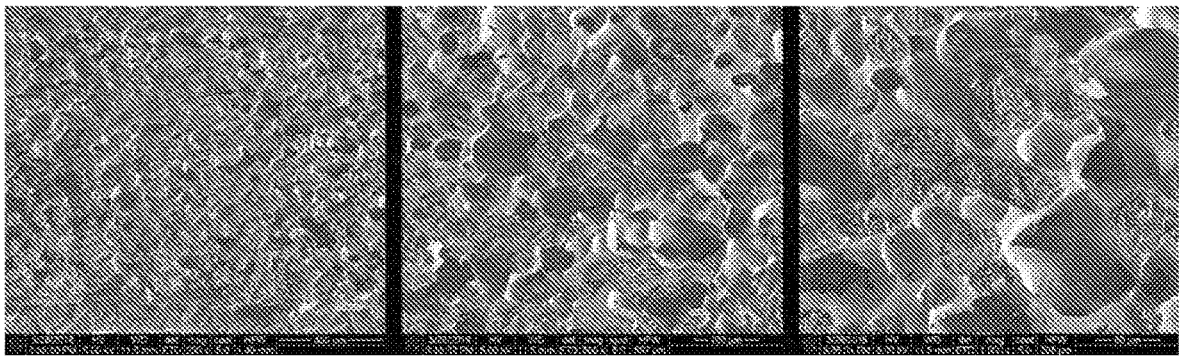
FIG. 7 shows SEM micrographs of Example 7, at 200× magnification (left), 500× magnification (center), and 1000× magnification (right).

FIG. 7 shows SEM micrographs of Example 7, at 200× magnification (left), 500× magnification (center), and 1000× magnification (right).

TABLE 1B

| | | Ex 3 | Ex 4 | Ex 5 | Ex 6 | Ex 7 |
|---|---|---|---|---|---|---|
| PUD Composition | STANFAX ™ 590 | 3.0 g | 4.5 g | 6.0 g | 9.0 g | — |
| | TRITON ™ CG-600 | — | — | — | — | 4.5 g |
| | SYNTEGRA ™ YS3000 | 300 g | 300 g | 300 g | 300 g | 300 g |
| PUD Solids Content[1] (wt %) | | 54.4 | 54.2 | 53.9 | 53.4 | 55.2 |
| Initial Textile Weight | | 29.70 g | 29.78 g | 30.33 g | 30.33 g | 29.69 g |
| Aqueous Solution Composition[2] | | 0.8 wt % UCARE ™ JR 400 | 0.8 wt % UCARE ™ JR 400 | 0.8 wt % UCARE ™ JR 400 | 0.8 wt % UCARE ™ JR 400 | 0.8 wt % UCARE ™ JR 400 |
| Aqueous Solution in Modified Textile Component[3] | | 33.08 g UCARE ™ JR 400 | 33.24 g UCARE ™ JR 400 | 38.25 g UCARE ™ JR 400 | 39.46 g UCARE ™ JR 400 | 34.43 g UCARE ™ JR 400 |
| PUD in Synthetic Leather Before Drying[4] | | 39.63 g | 39.55 g | 36.01 g | 31.44 g | 37.57 g |
| Polyurethane in Synthetic Leather After Drying[5] | | 20.51 g | 17.69 g | 16.92 g | 17.39 g | 19.32 g |

[1]PUD Solids Content weight percent is based on the total weight of the PUD, including the second surfactant.
[2]UCARE Solution percentage is the wt % of the hydroxyethylcellulose polymer with a quaternary ammonium cation group, based on the total weight of the aqueous solution.
[3]Aqueous Solution in Modified Textile Component is measured after the modified textile component is removed from the aqueous solution and pressed with a Werner Mathis AG, VFM 28888 two-roller machine.
[4]PUD in Synthetic Leather Before Drying is measured after the synthetic leather is removed from the PUD and pressed with a Werner Mathis AG, VFM 28888 two-roller machine.
[5]Polyurethane in Synthetic Leather After Drying is measured after the synthetic leather is then dried in an oven for 15 minutes at 90° C. followed by 15 minutes at 120° C.

Results

The properties of each synthetic leather are provided in Table 2.

The Cation:Anion Ratio of each Comparative Sample and Example is calculated in accordance with Equation (A):

$$\frac{\text{Cation}}{\text{Anion}} = \frac{[JR\text{ solution weight}]\times[JR\text{ solution }\%]\times[\text{Nitrogen }\%\text{ in }JR]/[\text{molecular weight of nitrogen}]}{[PUD\text{ weight}]\times[PUD\text{ solids }\%]\times[\text{surfactant }\%\text{ in }PUD]/[\text{molecular weight of surfactant}]}. \quad \text{Equation (A)}$$

In Equation (A), "JR" refers to UCARE™ JR 400 and "surfactant" refers to the sulfonate surfactant from the SYNTEGRA™ YS3000. The "molecular weight of nitrogen" is equal to 14 g/mol. The "molecular weight of surfactant" is equal to 348 g/mol.

The properties of each synthetic leather are provided in Table 2.

TABLE 2

| Sample | Aqueous Solution[1] | PUD Second Surfactant[2] | Initial Textile Weight (g) | Aqueous Solution Pick-Up (g) | Modified Textile Component wt % Aqueous Solution[3] | PUD Pick-Up (g) | Polyurethane Pick-Up (g)[4] | Cation: Anion Ratio | Synthetic Leather Weight After Drying (g) | Synthetic Leather Polyurethane wt % After Drying[5] | Handfeel[7] | Wrinkles[6] |
|---|---|---|---|---|---|---|---|---|---|---|---|---|
| CS 1 | — | — | 16.30 | — | — | 16.75 | 9.13 | — | 25.43 | 35.9 wt % | 2 | yes |
| CS 2 | — | 1.5% STANFAX ™ 590 | 29.01 | — | — | 19.59 | 10.15 | — | 39.16 | 25.9 wt % | 5 | yes |
| Ex 3 | 0.8% UCARE ™ JR 400 | 1.0% STANFAX ™ 590 | 29.70 | 33.08 | 52.7 wt % | 39.63 | 20.51 | 0.20 | 50.21 | 40.8 wt % | 4 | no |
| Ex 4 | 0.8% UCARE ™ JR 400 | 1.5% STANFAX ™ 590 | 29.78 | 33.24 | 52.7 wt % | 39.55 | 17.69 | 0.20 | 47.47 | 37.2 wt % | 5 | no |
| Ex 5 | 0.8% UCARE ™ JR 400 | 2.0% STANFAX ™ 590 | 30.33 | 38.25 | 55.8 wt % | 36.01 | 16.92 | 0.25 | 47.25 | 35.8 wt % | 5 | no |
| Ex 6 | 0.8% UCARE ™ JR 400 | 3.0% STANFAX ™ 590 | 30.33 | 39.46 | 56.8 wt % | 37.57 | 19.32 | 0.25 | 49.65 | 38.9 wt % | 6 | no |

TABLE 2-continued

| Sample | Aqueous Solution[1] | PUD Second Surfactant[2] | Initial Textile Weight (g) | Aqueous Solution Pick-Up (g) | Modified Textile Component wt % Aqueous Solution[3] | PUD Pick-Up (g) | Polyurethane Pick-Up (g)[4] | Cation: Anion Ratio | Synthetic Leather Weight After Drying (g) | Synthetic Leather Polyurethane wt % After Drying[5] | Handfeel[7] | Wrinkles[6] |
|---|---|---|---|---|---|---|---|---|---|---|---|---|
| Ex 7 | 0.8% UCARE ™ JR 400 | 1.5% TRITON ™ CG-600 | 29.69 | 34.43 | 53.7 wt % | 37.57 | 19.32 | 0.21 | 49.01 | 39.4 wt % | 5 | no |

[1]UCARE Solution percentage is the wt % of the hydroxyethylcellulose polymer with a quaternary ammonium cation group, based on the total weight of the aqueous solution.
[2]The PUD percentage is the wt % of second surfactant, based on the total weight of the PUD.
[3]The Modified Textile Component wt % Aqueous Solution is the wt % of aqueous solution present in the modified textile component before drying, based on the total weight of the modified textile component.
[4]The Polyurethane Pick-Up is the amount in grams (g) of polyurethane present in the synthetic leather after drying.
[5]The Synthetic Leather Polyurethane wt % After Drying is the wt % of polyurethane that is present in the synthetic leather after drying, based on the total weight of the synthetic leather.
[6]Wrinkles present after folding.
[7]Handfeel is subjectively determined on a scale of 1 to 6, with 1 indicating a sample is very hard, 2 indicating a sample is hard, 3 indicating a sample is somewhat hard, 4 indicating a sample is somewhat soft, 5 indicating a sample is soft, and 6 indicating a sample is very soft.
NM = not measured Comparative Sample 1, which is prepared (i) without contacting a textile with an aqueous solution containing a cationic hydroxyethylcellulose polymer to form a modified textile component, and (ii) by impregnating the modified textile component with a PUD that lacks a second surfactant, has hard handfeel (exhibited by a handfeel rating of 2) and exhibits wrinkles after hand-squeezing. Consequently, Comparative Sample 1 is not suitable for synthetic leather applications.

Comparative Sample 2, which is prepared without contacting a textile with an aqueous solution containing a cationic hydroxyethylcellulose polymer to form a modified textile component, exhibits visible wrinkles after folding. Consequently, Comparative Sample 2 is not suitable for synthetic leather applications.

Examples 3-7, which are prepared by first contacting a textile with an aqueous solution comprising a cationic hydroxyethylcellulose polymer to form a modified textile component; then, impregnating the modified textile component with a PUD externally stabilized with an anionic surfactant, the PUD containing a second surfactant (STANFAX™ 590 or 1.5% TRITON™ CG-600); precipitating the polyurethane in the modified textile component; and forming a synthetic leather, advantageously exhibit good coagulation (as evidenced by the formation of pores in the polyurethane matrix, shown in FIGS. 3-7). Further, the polyurethane matrix of Examples 3-7 each exhibits a more uniform distribution of pores throughout the polyurethane matrix (i.e., pores having the same, or substantially the same, size that are evenly distributed throughout the polyurethane matrix), and further throughout the synthetic leather, which endows the synthetic leather with soft handfeel (exhibited by a handfeel rating from 4 to 6), prevents wrinkles from forming in the synthetic leather after folding, lowers the weight of the synthetic leather, and lowers the total material cost of the synthetic leather. Examples 3-7 surprisingly exhibit the combination of soft handfeel (exhibited by a handfeel rating from 4 to 6) and no visible wrinkles after folding. Consequently, Examples 3-7 are suitable for synthetic leather applications such as shoes, upholstery, and automobile interiors.

It is specifically intended that the present disclosure not be limited to the embodiments and illustrations contained herein, but include modified forms of those embodiments including portions of the embodiments and combinations of elements of different embodiments as come within the scope of the following claims.

We claim:

1. A process comprising:

(i) first, contacting a textile with an aqueous solution comprising a cationic hydroxyethylcellulose polymer to form a modified textile component;

(ii) subsequently, impregnating the modified textile component with an aqueous polyurethane dispersion externally stabilized with an anionic surfactant, the aqueous polyurethane dispersion comprising a second surfactant; and (iii) precipitating the polyurethane in the modified textile component.

2. The process of claim 1 comprising (iv) forming a synthetic leather.

3. The process of claim 1 comprising selecting a cationic hydroxyethylcellulose polymer that is a hydroxyethylcellulose polymer with a quaternary ammonium cation group.

4. The process of claim 1 comprising selecting a cationic hydroxyethylcellulose polymer having a weight average molecular weight (Mw) from 100,000 Dalton to 3,000,000 Dalton.

5. The process of claim 1 comprising selecting the second surfactant from the group consisting of a zwitterionic surfactant, a nonionic surfactant, and combinations thereof.

6. The process of claim 1 comprising dissolving the second surfactant in the aqueous polyurethane dispersion; and forming the aqueous polyurethane dispersion comprising from 0.5 wt % to 5.0 wt % of the second surfactant, based on the total weight of the aqueous polyurethane dispersion.

7. The process of claim 1 comprising maintaining, during the impregnating, a Cation:Anion Ratio from 0.1 to 10.

8. The process of claim 1 comprising drying the modified textile component before impregnating the modified textile component with the aqueous polyurethane dispersion.

9. The process of claim 1 comprising forming a synthetic leather comprising from 35 wt % to 70 wt % polyurethane.

10. A synthetic leather produced by the process of claim 1.

* * * * *